US006871457B2

(12) United States Patent
Quintero-Flores et al.

(10) Patent No.: US 6,871,457 B2
(45) Date of Patent: Mar. 29, 2005

(54) VESSEL FOR ENABLING A UNIFORM GRAVITY DRIVEN FLOW OF PARTICULATE BULK MATERIAL THERETHROUGH, AND DIRECT REDUCTION REACTOR INCORPORATING SAME

(75) Inventors: Raul Gerardo Quintero-Flores, Nuevo Leon (MX); Jorge Octavio Becerra-Novoa, Nuevo Leon (MX); Juan Celada-Gonzalez, Nuevo Leon (MX); Maria Teresa Guerra-Reyes, Nuevo Leon (MX); Ronald Victor Manuel Lopez-Gomez, Nuevo Leon (MX)

(73) Assignee: Hylsa, S.A. DE C.V., Nuevo Leon (MX)

( * ) Notice: Subject to any disclaimer, the term of this patent is extended or adjusted under 35 U.S.C. 154(b) by 304 days.

(21) Appl. No.: 10/161,427

(22) Filed: May 30, 2002

(65) Prior Publication Data

US 2002/0179640 A1 Dec. 5, 2002

Related U.S. Application Data

(60) Provisional application No. 60/294,928, filed on May 31, 2001.

(51) Int. Cl.[7] ..... B67C 11/00

(52) U.S. Cl. ..... 52/197; 222/460

(58) Field of Search ..... 222/185.1, 195, 222/630, 460; 52/197

(56) References Cited

U.S. PATENT DOCUMENTS

| | | | | |
|---|---|---|---|---|
| 1,479,660 A | | 1/1924 | Fuller | |
| 3,797,707 A | | 3/1974 | Jenike et al. | 222/193 |
| 3,921,351 A | | 11/1975 | Johnson | 52/197 |
| 4,886,097 A | | 12/1989 | Garza-Ondarza | 141/333 |
| 6,029,838 A | | 2/2000 | Hansen et al. | 220/4.03 |
| 6,055,781 A | | 5/2000 | Johanson | 52/197 |
| 6,089,417 A | * | 7/2000 | Snekkenes et al. | 222/460 |
| 6,250,514 B1 | * | 6/2001 | Hansson | 222/185.1 |

* cited by examiner

*Primary Examiner*—Philippe Derakshani
(74) *Attorney, Agent, or Firm*—Darby & Darby

(57) ABSTRACT

So as to provide a container that is inexpensive to manufacture and that promotes a uniform flow of particulate bulk materials therethrough, a vessel is suggested comprising at least two wall segments having a generally downwardly converging wall defining a vertical axis for the vessel, a first upper segment being vertically arranged above a second lower segment, each one of the wall segments having an upper edge and a lower edge, the perimeter of the upper edge of the second lower wall segment being larger than the perimeter of the lower edge of the first upper wall segment the lower edge of the first upper wall segment and the upper edge of the second lower wall segment being positioned proximate to each other and cooperating to provide an enlargement of the cross-sectional area of the volume occupied by the particulate solid material.

50 Claims, 3 Drawing Sheets

VESSEL FOR ENABLING A UNIFORM GRAVITY DRIVEN FLOW OF PARTICULATE BULK MATERIAL THERETHROUGH, AND DIRECT REDUCTION REACTOR INCORPORATING SAME

This application claims the priority of U.S. Provisional Application No. 60/294,928, filed on May 31, 2001 which is hereby incorporated hereby by reference in its entirety.

FIELD OF THE INVENTION

The invention relates to an improved configuration of bins, hoppers, silos, reactors, and more generally to any vessel for handling, processing, transporting or temporarily storing particulate bulk materials.

A particularly useful application of the invention is related to a Direct Reduction Reactor of particulate iron ores.

BACKGROUND OF THE INVENTION

It is common in many industries to use containers or vessels for handling, processing, transporting or temporarily storing particulate bulk materials. The geometrical configuration of such containers or vessels is of utmost importance in order to assure the desired type of flow of particles through said vessels. Depending on such factors and characteristics of the particles, as for example, the size and shape of the particles, the friction forces developed in the body of the bulk material as well as the friction forces between the particles and the wall of the container and the pressure exerted on said particles caused by the weight of the mass of particles, primarily the shape of the vessel but also its dimensions relative to the particles to be handled, determines whether the particles will flow freely by the action of gravity or will form bridges or domes which stop said flow or at least produce non-uniform flow thereof.

U.S. Pat. No. 4,886,097 to Garza-Ondarza discloses a single segment container to handle particulate solids comprising a downwardly converging wall which wall is provided with an internal inverted step extending along a portion of the converging wall. The internal inverted step extends helically along at least a portion of the converging wall to provide a continuous increase in the cross-sectional area of the container to promote the flow of solids.

This patent provides an enlargement of the cross-sectional area of the container and in this way the solids compaction is minimized allowing configurations of the container with narrower outlet diameters. The measures proposed by this patent however, although effective in achieving its object, are difficult to incorporate in a cost-effective manner because the construction of the helical step along the conical portion of the container raises the costs incurred by the actual cutting and conformation of the metal sheet employed for constructing such container. This becomes more relevant when the spiral inverted step is to be incorporated in a large reactor which has to withstand high internal pressures.

U.S. Pat. No. 6,055,781 describes a hopper that has been developed to reduce the tendency of particulate material to form bridges by providing a shape so that its walls slope downward more steeply with increasing height above the outlet. The disclosed hopper comprises several adjacent conical sections that are arranged along a common longitudinal axis. In the downward direction, the conicity of the adjacent sections decreases.

U.S. Pat. No. 3,797,707 describes a bin for storage and flow of bulk solids having stepped hopper surfaces adapted to increase and render constant the rate of flow at the hopper outlet. The stepped surfaces have friction and slope angles adapted to satisfy the criteria for mass flow, and provide spaces for injecting fluid at one or more perimetric interfaces with the moving solids. This patent suggests an enlargement of the cross sectional area of the bin. To this end, it is propagated to arrange several conical segments adjacent one another and along a common longitudinal axis. The segments are dimensioned and arranged in the longitudinal direction so that they are joined by horizontal wall segments. The walls of this known container may still provide a support for the formation of domes by the particles. The injection of a fluid may not be possible to practice in many applications and entails additional operational costs.

U.S. Pat. No. 3,921,351 discloses a segmented storage bin of circular or square cross-section for storing and dispensing particulate material comprising several bin segments; the cross-section of the bin is enlarged by the combination of intermediate wall segments providing an enlargement of the cross sectional area of the bin. The concept described in this patent however does not eliminate the formation of domes by the solid particles.

U.S. Pat. No. 6,089,417 describes a chip bin comprising a discharge zone having a curvilinear roller shape in any freely chosen horizontal cross-section wherein the cross-section of the discharge zone decreases downwardly. In the cross-sectional view along the longitudinal axis of the known chip bin, some segments of the bin have a vertical wall on one side and an angled wall on the opposite side. The bin of this patent also has the disadvantage of a complicated and costly construction because of the shape of the segments as shown in the patent.

SUMMARY OF THE INVENTION

In view of this prior art, it is an object of the invention to provide a vessel or container that is inexpensive to manufacture and that promotes a uniform flow of particulate bulk materials therethrough. In particular, the stoppages caused by said materials hanging or dome bridging inside the converging zone of such container is to be minimized without resorting to moving parts.

This object is solved by a vessel having the features of claim 1 and by a vessel having the features of claim 23 below. A further solution is provided by a direct reduction reactor having the features of claim 20 below. Further advantageous embodiments are provided in the dependent claims, respectively.

The present invention is based on the concept to provide an expansion of the cross sectional area of the inventive vessel which is asymmetrical at least in one direction with respect to a horizontal plane. This feature of the invention produces a uniform gravity driven flow of particles and eliminates the possibility of formation of bridges or domes which interrupt the flow of particles.

This concept is reflected in the feature of claim 1 requiring the lower edge of the upper wall segment to extend outside a plane that is perpendicular to the longitudinal axis of the upper wall segment, and/or requiring the upper edge of the lower wall segment to extend outside a plane that is perpendicular to the longitudinal axis of the lower wall segment; in claim 23, the corresponding limitation requires an angle to be present, to achieve the desired technical effect of producing a uniform gravity driven flow of particles. Some wall segments of the present invention converge along their longitudinal axis. This convergence along a straight line facilitates easier manufacturing and assembly, but conver gence of each converging wall segment along a curve is also contemplated. The angle of convergence is measured from the longitudinal axis to the wall of the wall segment, as seen in the direction of convergence.

Although it is preferred that the longitudinal axes of the wall segments of the inventive vessel coincide, it is also contemplated to arrange these axes parallel to and spaced from one another. Coinciding axes will improve the flow of particles through the inventive vessel, and spaced parallel axes allow for greater flexibility concerning the inventive vessel's requirement for space.

The direct reduction reactor in accordance with the present invention is particularly suitable for processing particles of iron oxides containing materials at high temperatures, so as to produce metallic iron in the solid state. In the inventive direct reduction reactor, the iron oxide particles can flow by gravity in a uniform plug flow pattern, and the range of lump ores and/or pellets expands, because the inventive direct reduction reactor minimizes the possibility of dome bridging in the discharge zone of the reactor.

The present invention provides a better solution to the tendency of solid particles to bridge within the container, by providing an enlargement of its cross-sectional area but with a better design and a more cost-effective facility for its construction.

Other features and advantages of the invention will be pointed out hereafter.

DETAILED DESCRIPTION OF A PREFERRED EMBODIMENT

Figure 2:
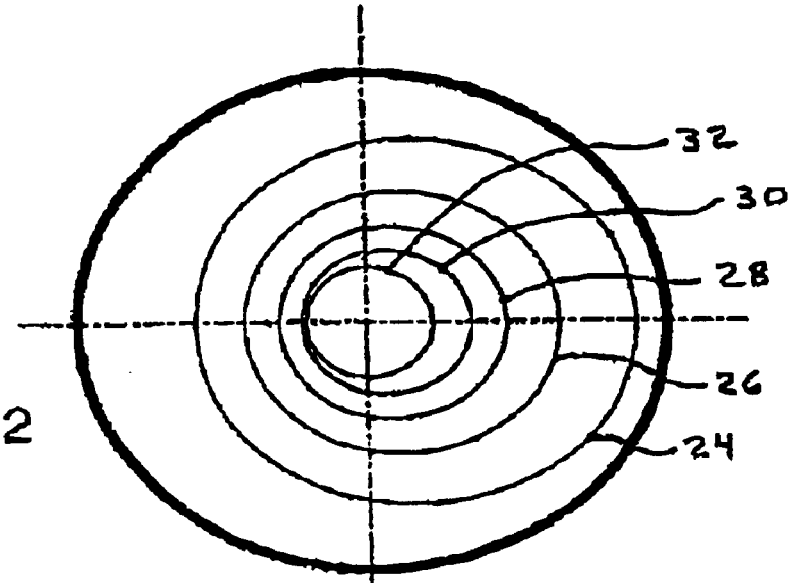
FIG. 2 is a plan view of the same embodiment of FIG. 1.

In the figures, a preferred embodiment of the present invention is depicted, and the inventive vessel is generally designated with reference numeral 10. Throughout the drawing figures, the same or corresponding element are designated with identical reference numerals.

Figure 1:
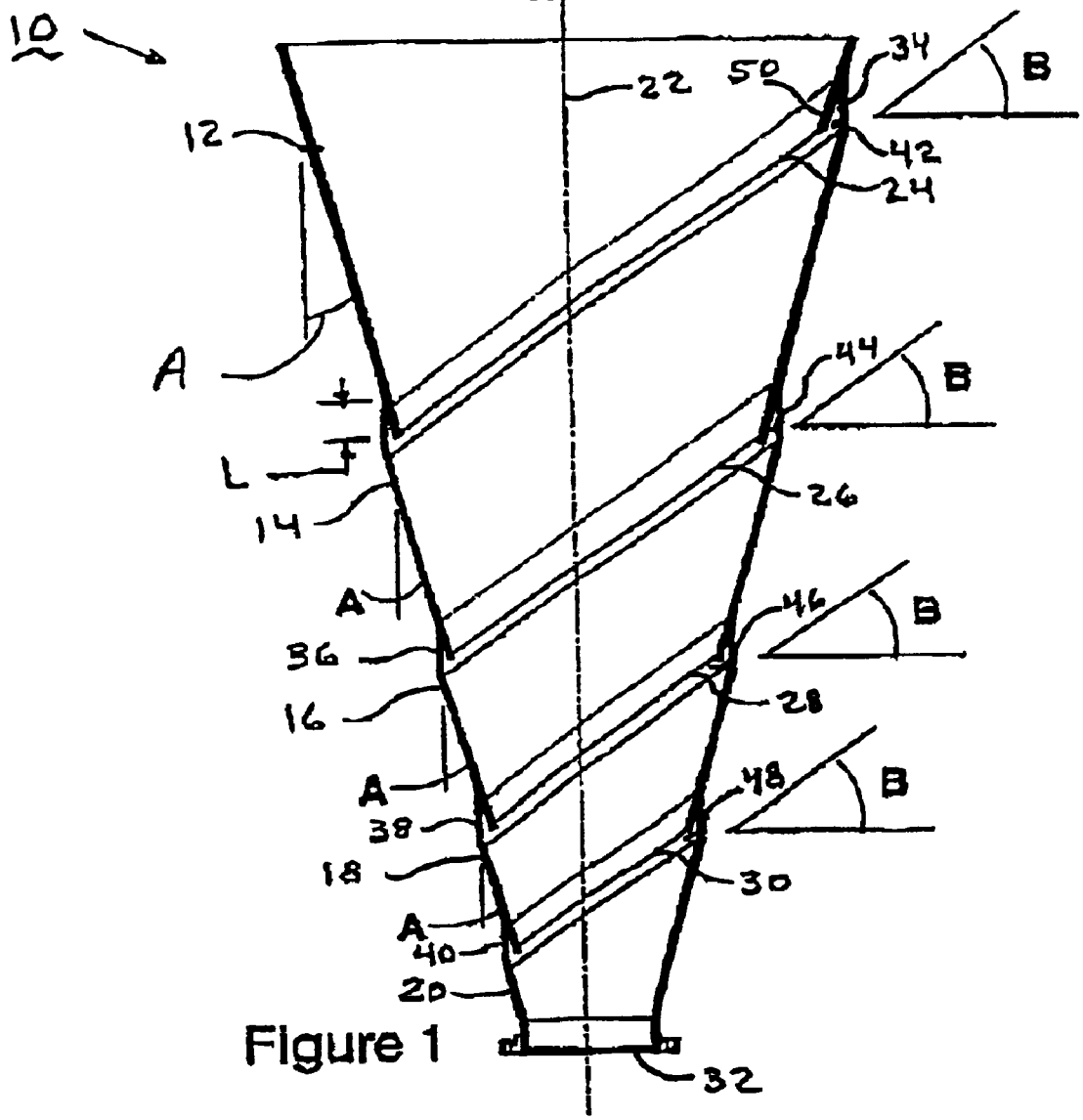
FIG. 1 is a vertical side view of a vessel incorporating a preferred embodiment of the invention.

Although vessel 10 in FIG. 1 is depicted as having various conical segments 12, 14, 16, 18 and 20, it would be sufficient to embody the present invention, if the vessel 10 only comprised an upper wall segment 12, a lower wall segment 14, and an intermediate wall segment 34. In FIG. 1, various of these upper wall segments, lower wall segments and intermediate wall segments are depicted, the intermediate wall segments linking the respective upper and lower wall segments. In this manner, for example, conical wall segment 18 in FIG. 1 functions as an upper wall segment for the combination of wall segments 18, 40 and 20, and at the same time as a lower wall segment for the combination consisting of wall segments 16, 38 and 18. In this connection, it should be noted that, although the terminology "upper" and "lower" reflect the preferred orientation of the inventive vessel in use, such as it is depicted in FIG. 1, they mainly serve to identify relative orientations, and not to identify an absolute location or orientation of the inventive vessel.

Further with reference to FIG. 1, in the vertical cross-sectional view of a vessel 10 of a preferred embodiment of the invention, conical segments 12, 14, 16, 18 and 20 are depicted, all of which are generally centered with respect to the longitudinal, and in use of the vessel typically substantially vertical, axis 22 of vessel 10. In this preferred embodiment, the longitudinal axes of the various conical segments 12, 14, 16, 18 and 20 coincide, which is particularly evident from FIG. 2. It is, however, also within the scope of the invention to arrange the vertical axes of the conical segments 12, 14, 16, 18 and 20 so that they do not coincide, as long as they are arranged parallel to one another.

Conical segments 12 to 18 are generally shaped with an angle A with respect to their respective vertical axes. This angle A of the conical segments is selected in accordance with the flow characteristics of the particular solid bulk material to be handled by vessel 10, and in accordance with the optimization of the height of the vessel which results from steeper but more flow favorable values of angle A and from the necessity of having plug flow through the vessel or at an upper generally cylindrical section 26 of vessel 10.

Angle A will be selected by the skilled person in accordance with the application of vessel 10. For the preferred application, in direct reduction reactors, angle A is most preferably in the range from 11° to 18°. Although it is preferred to have segments 12 to 18 shaped with the same angle A, for some materials it may be desirable to decrease the angle A of each segment, with the smallest angle at the bottom of vessel 10. This decreasing conical angle A promotes the flow of particles to be more vertical where the cross-sectional area is smaller.

Segment 12 has a lower elliptical edge 24 resulting from truncating the cone 12 at an angle B. Angle B is in the range from 20° to 60° with respect to the horizontal, and more preferably between 35° to 45° with respect to the horizontal. In the preferred, substantially vertical orientation of vessel 10, these angles B translate into an angle in the range from 30° to 70°, and preferably 35° to 55° with respect to the longitudinal axis of wall segment 12. It is most preferred that angle B is 40°, so as to ensure optimum flow and to eliminate the possibility of formation of domes which could interrupt the flow of particles, in the preferred application of vessel 10. It is of course to be understood that the lower edge does not necessarily have to be elliptical, since the concept of the invention may be implied to vessels or containers having cross-sectional areas other than circular, for example rectangular.

Segments 14, 16 and 18 have similarly elliptical lower edges 26, 28, and 30, respectively. Each of the segments 12, 14, 16, 18 and 20 of vessel 10 cooperates with its adjacent segment or segments in order to provide an expansion of the cross sectional area of the flow channel of the preferably solid particles passing successively through segments 12 to 20. It is a distinctive feature of vessel 10 that this expansion of the cross sectional area is asymmetrical at least in one direction with respect to a horizontal plane. This minimizes the possibility of formation of bridges or domes by the gravity driven particles, because the supporting wall or supporting walls are asymmetric as regards the direction of gravity.

The preferably elliptical recess spaces enclosed by the intermediate wall segments are oriented in the same direction, i.e. their longitudinal axis is oriented parallel to the longitudinal axes of conical segments 12, 14, 16, 18 and 20. The level of the highest point of each one of said intermediate wall segments is located at the same height or above the level of the lowest points of its associated upper wall segment, i.e. of the recess space above it, thus providing a continuous asymmetry in the walls of vessel 10; it should be noted that the invention also comprises embodiments where the space recesses are separated vertically by a distance longer or shorter than that depicted in the Figures, so that they effectively overlap or leave some zones without said cross-sectional area enlargements. The orientation of at least some or all of said recesses can also be different.

In FIG. 1, the lower edge portion 50 of the upper wall segment 12 is connected to the upper edge of intermediate wall element 34. As connection between the upper edge of the intermediate wall segment 34 and the upper wall segment 12 is preferably not with the lower edge 24 of upper wall segment 12, but with the lower edge portion 50, the mentioned overlap results, as depicted in FIG. 1. As it is understood in this document, the term lower edge portion includes the lower edge.

Intermediate wall segment 34 is with its lower edge attached to the upper edge of lower wall segment 14. The intermediate wall segment 34 is of generally circular cross-section and encloses a space 42 formed between the intermediate wall segment 34. This space 42 enlarges the effective cross sectional area of the vessel 10 and allows the particles to be handled to expand therein and to release some of the pressure acting on said downwardly flowing particles. The lower edge portion 50 of upper wall segment 12 may extend in this overlap over a certain distance L into vessel 10. The preferred value of this distance L will be selected in accordance with the size and shape of the particles to be handled, and also according to the heat transfer requirements which may be imposed by the temperatures inside vessel 10. For example, when the present invention is applied to reactors for the direct reduction of iron oxides where the particulate material may reach temperatures in the range of 500° C. to 850° C., the length L may be in the range from 5 cm to 20 cm. In applications of the invention to reactors or bins handling particles at high temperatures, this overlap L may be dimensioned so that the heat transferred from the particles may be dissipated by conduction to the rest of the vessel wall thus advantageously dispensing with the need for additional cooling systems to cool said overlap.

Similar to intermediate wall segment 34, other intermediate wall segments 36, 38 and 40 are provided to define further expansions of the cross sectional area. These expansions are designated as 44, 46 and 48 (FIG. 1).

Figure 3:
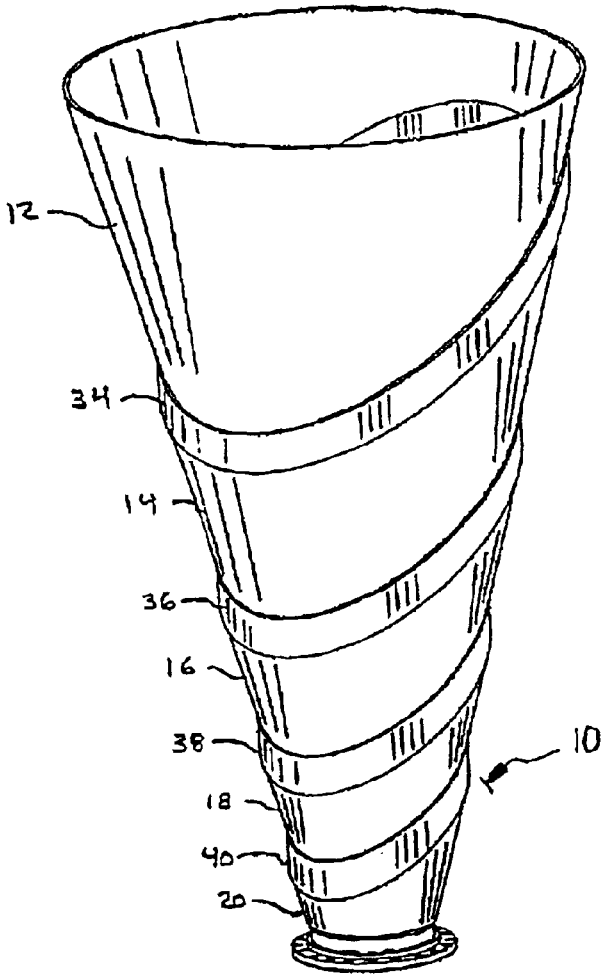
FIG. 3 is a perspective external view of the embodiment of FIG. 1.
Figure 4:
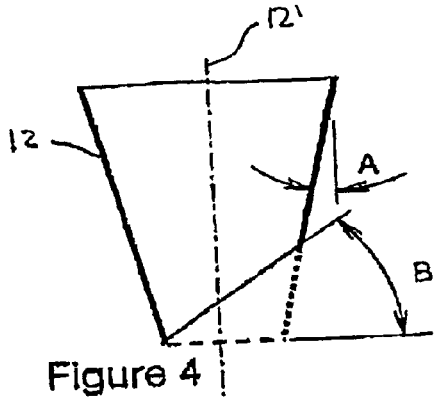
FIG. 4 shows a diagrammatic construction of the top segment of the vessel shown in FIG. 1.
Figure 5:
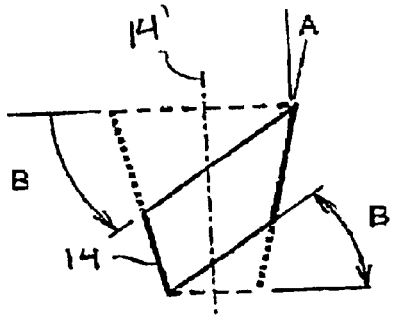
FIG. 5 shows a diagrammatic construction of an intermediate segment of the vessel shown in FIG. 1.
Figure 6:
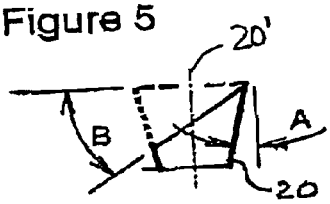
FIG. 6 shows a diagrammatic construction of the bottom segment of the vessel shown in FIG. 1.

The upper and lower wall segments 12 to 20 may be constructed from conical shapes conformed and cut at the selected angle B, as shown in FIGS. 4 to 6. As can be appreciated from these figures, and also from FIG. 3, there is a clear advantage in configuring upper and lower wall segments 12 to 20 as well as intermediate wall segments 34, 36, 38 and 40 in this manner. In particular, these segments may be manufactured with some tolerance to their dimensions, simply telescopically inserted into one another and subsequently be connected, for example by welding. This manufacturing is considerably more cost efficient than the prior art construction which proposed a continuous spirally shaped wall element.

In FIG. 4, the uppermost upper wall segment is depicted. It is of truncated cone shape with the base of the core being depicted near the upper end of the Figure, and the plane of truncation depicted near the lower end of FIG. 4. The base of the cone shape of the uppermost upper wall segment 12 is perpendicular to the longitudinal axis 12', and the plane of truncation is inclined relative to the longitudinal axis 12'. In particular, the angle of inclination B is non-perpendicular to axis 12'.

The lower wall segment in the combination of wall segments 12, 34 and 14 (FIG. 3), namely wall segment 14, is depicted in more detail in FIG. 5. As is evident from FIG. 5, wall segment 14 is also of truncated cone shape, the base of the cone being depicted near the upper end of the Figure and in this case also inclined relative to the longitudinal axis 14' of segment 14. The angle of inclination relative to longitudinal axis 14' of segment 14 matches the angle of inclination of the plane of truncation of upper wall segment 12. Likewise, the angle of inclination B of the plane of truncation of wall segment 14 in inclined at the same angle B relative to its longitudinal axis 14'.

In FIG. 6, a further "lower" wall segment is depicted, in this case the lowermost wall segment of vessel 10 in FIG. 3. This lowermost wall segment 20 is also of truncated cone shape, the base being depicted near the upper end of the Figure, and the plane of truncation near the lower end of FIG. 6. The angle of inclination of the base of the cone shape of wall segment 20 is inclined at the same angle of inclination B relative to the longitudinal axis 20' of wall segment 20. In this manner, the vessel 10 depicted in FIG. 3 can more easily be manufactured and assembled. The lowermost wall segment can terminate in an outlet discharge 32 (FIG. 1).

Figure 7:
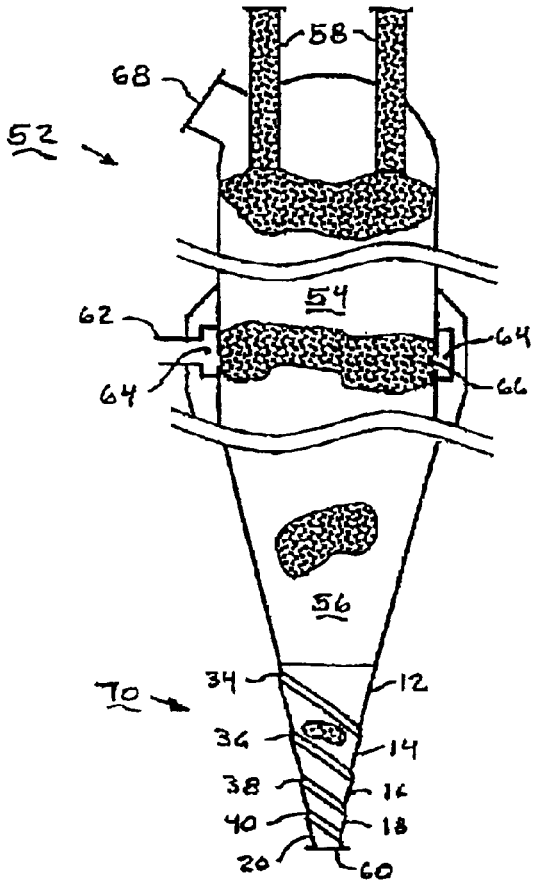
FIG. 7 is a diagrammatic side view of a direct reduction reactor embodying the present invention.

Referring now to FIG. 7, reference numeral 52 generally designates a direct reduction reactor having an upper reduction zone 54 and a lower discharge zone 56. Particulate iron oxides material in the form of lumps, pellets or mixtures thereof is fed to reactor 52 through feed pipes 58 and the material flows by gravity downwardly through reactor 52 at a regulated rate by conventional means (not shown for simplicity) and is discharged through outlet 60. The iron oxides are reduced to metallic iron by reaction with a reducing gas comprising hydrogen and carbon monoxide fed through feed inlet 62 and connected to distributing plenum 64 from which it is injected through nozzles 66 into the bed of particles, the gas flowing upwardly and counter-currently to the solid particles. The reacted gas is withdrawn through gas outlet 68 from which it is regenerated and recycled to reaction zone 54.

At the bottom portion of the conical discharge zone 56 vessel 70 is located which incorporates the features of the present invention as indicated by the same numerals designating the same elements shown in FIG. 1.

A typical direct reduction reactor has a diameter in its cylindrical part in the range of 4.5 to 6.5 meters, and its height is about 30 to 35 meters. The lowest portion where the invention is being incorporated (numeral 70) is about 7 meters tall, its wall converging from about 3 meters diameter to an outlet of about 1.0 meter diameter. The particles of reduced iron ore are comprised by lumps of irregular shape and pellets of generally spherical shape and mixtures of these materials. The particle size may vary from 3 mm to 30 mm and have a bulk density between 1.0 and 2.7 tons/cubic meter, usually from 1.4 to 2.0 tons/cubic meter. The friction angle between particles is typically in the range from 30 to 70 degrees and the friction angle between particles and the wall from about 20 to 35 degrees. Of course the value of friction angles vary in a wide range depending on many characteristics of the particles. The lowest segment of the reactor is usually made of carbon steel, but for some applications it may be made of high temperature resistant alloyed steel, (for example: inconel or stainless steel 304).

The tendency of the material in the reactor to form domes in vessel 70 wherein the internal diameter is smaller in comparison with the prior art is eliminated by the invention and the uniform flow of the solid particles throughout the reactor is improved thus rendering a more homogeneous quality of the product by the effect of the elliptical space recesses conformed and oriented at an angle B with respect to the reactor vertical axis, for example at 40°.

Figure 8:
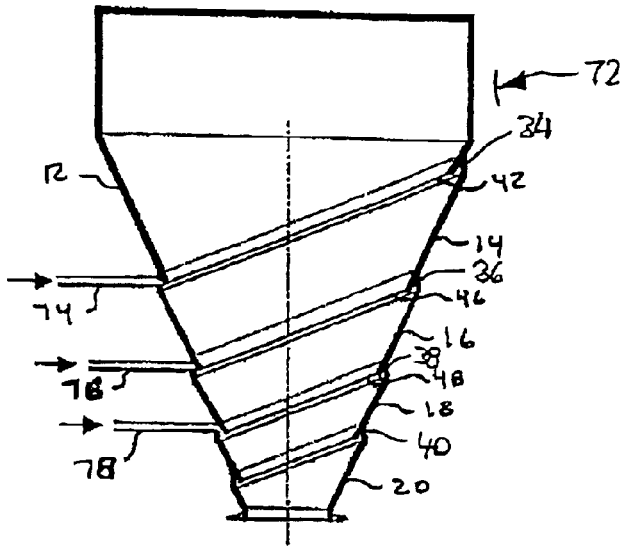
FIG. 8 is a side view of a storage bin embodying the present invention which may also comprise means for injecting a fluid to facilitate flow of the particulate material or react therewith.

FIG. 8 shows a holding bin 72 incorporating the features of the invention and additionally comprising means 74, 76 and 78 for injecting a fluid, for example air or any suitable gas according to the material being handled, into the recess spaces 42, 46 and 48 enclosed by intermediate wall segments 34, 36, 38 and 40. This fluid injection may be a gas or liquid for aerating small sized particulate materials thus facilitating their flow through the bin, or may be a liquid or gas utilized for treatment or reaction with the particulate materials.

It is of course to be understood that many modifications may be made to the invention and that the invention may be carried out through several embodiments without departing from the scope thereof as it is set forth in the following claims; for example it will be evident that the vessel may have a shape other than conical, like square or rectangular, and that the internal walls of the vessel may be lined with refractory or other material suitable for contacting the materials stored or processed in the vessel.

What is claimed is:

1. Vessel (10, 70) for enabling a uniform gravity driven flow of particulate bulk material therethrough, the vessel including at least an upper wall segment (12) having a longitudinal axis (FIG. 4: 12') and a wall converging along its longitudinal axis, the upper wall segment defining with an upper edge thereof a bulk material inlet, as well as a lower wall segment (14) having a longitudinal axis (FIG. 5: 14') and a wall converging along its longitudinal axis, the lower wall segment defining with a lower edge thereof a bulk material outlet, and the lower edge of the upper wall segment and/or the upper edge of the lower wall segment extending outside a plane perpendicular to the longitudinal axis of the respective wall segment.

2. Vessel as claimed in claim 1, further comprising a wall segment (34) intermediate the upper and the lower wall segments, the intermediate wall segment (34) being connected with an upper edge thereof to a lower edge portion (50) of the upper wall segment (12), and further being connected with a lower edge thereof to an upper edge of the lower wall segment (14).

3. Vessel as claimed in claim 2, wherein the intermediate wall segment (34) has a longitudinal axis and a wall parallel to the longitudinal axis.

4. Vessel as claimed in claim 2, wherein said intermediate wall segment (34) has a longitudinal axis and is connected such that the longitudinal axes of the upper wall segment, the lower wall segment and the intermediate wall segment are parallel to one another.

5. Vessel as claimed in claim 3, wherein the intermediate wall segment (34) is connected to the upper (12) and the lower (14) wall segments so that the longitudinal axes of the upper wall segment, the lower wall segment and the intermediate wall segment coincide and form a longitudinal axis (22) of the vessel.

6. Vessel as claimed in claim 1, wherein the converging wall of the upper wall segment (12) forms a converging angle (A) in the range from 8° to 45° with respect to the longitudinal axis (14') thereof.

7. Vessel as claimed in claim 1, wherein the converging wall of the upper wall segment (12) defines a truncated cone shape, the upper edge of the upper wall segment defining the base of the cone and the lower edge (24) of the upper wail segment (12) defining the plane of truncation, and the base and/or the plane of truncation being inclined (B) relative to the longitudinal axis (12') of the upper wall segment.

8. Vessel as claimed in claim 7, wherein the angle of inclination of the plane of truncation forms an angle (B) in the range from 30° to 70° with respect to the longitudinal axis of the upper wall segment.

9. Vessel as claimed in claim 1, wherein the converging wall of the lower wall segment (14) forms a converging angle (A) in the range from 8° to 45° with respect to the longitudinal axis (14') thereof.

10. Vessel as claimed in claim 1, wherein the converging wall of the lower wall segment (14) defines a truncated cone shape, the upper edge of the lower wall segment defining the base of the cone and the lower edge of the lower wall segment defining the plane of truncation, and the base and/or the plane of truncation being inclined (B) relative to the longitudinal axis (14') of the lower wall segment.

11. Vessel as claimed in claim 10, wherein the angle of inclination of the plane of truncation forms an angle (B) in the range from 30° to 70° with respect to the longitudinal axis (14') of the lower wall segment (14).

12. Vessel as claimed in claim 1, wherein the converging walls of the upper (12) and the lower (14) wall segments form converging angels (A) with respect to their respective longitudinal axis (12', 14'), the angles decreasing from the upper wall segment to the lower wall segment of said vessel.

13. Vessel as claimed in claim 2, wherein the intermediate wall segment (34) has a longitudinal axis and the wall of the intermediate wall segment (34) defines a cylinder, the upper edge of the intermediate wall segment defining an upper end plane inclined relative to the longitudinal axis of the intermediate all segment, and/or the lower edge of the intermediate wall segment defining a lower end plane inclined relative to the longitudinal axis of the intermediate wall segment.

14. Vessel as claimed in claim 13, wherein the cylinder has an elliptical cross section.

15. Vessel as claimed in claim 2, wherein the upper edge of the intermediate wall segment (34) defines a cross-sectional area larger than a cross sectional area defined by the lower edge (24) of the upper wall segment (12), and/or the lower edge of the intermediate wall segment (34) defines a cross-sectional area smaller than a cross sectional area defined by the upper edge of the lower wall segment (14).

16. Vessel as claimed in claim 1, including a plurality of the upper wall segments (12, 14, 16, 18), the uppermost (12) of the upper wall segments defining with its upper edge the bulk material inlet of the vessel (10, 70), the vessel further including a plurality of lower wall segments (14, 16, 18, 20), the lowermost (20) of the lower wall segments defining with its lower edge the bulk material outlet of the vessel (10, 70).

17. Vessel as claimed in claim 16, further including a plurality of intermediate wall segments (34, 36, 38, 40).

18. Vessel as claimed in claim 1, wherein the upper and the lower wall segments generally have a circular or a rectangular cross section.

19. Vessel as claimed in claim 2 for use as a holding bin (72) for particulate material and including means (74, 76, 78) to inject a fluid into the vessel, wherein said means is arranged to inject the fluid into at least one of the intermediate wall segments (34, 36, 38).

20. Direct reduction reactor (52) for processing particles containing iron oxides to produce particles containing metallic iron in the sold state, including a vessel (70) as claimed in claim 1.

21. Direct reduction reactor as claimed in claim 20, wherein the vessel (70) is located proximate to the discharge outlet (60) of the direct reduction reactor (52).

22. Direct reduction reactor as claimed in claim 20, wherein the vessel (70) has four intermediate wall segments (34, 36, 38, 40).

23. Vessel (10, 70) through which a particulate bulk solid material is caused to flow by gravity including a portion downwardly converging to a discharge outlet for said material and which minimizes the formation of domes or bridges by the particles of said solid material and which facilitates the uniform mass flow of said particles therethrough, the vessel comprising at least two wall segments (12, 14) having a generally downwardly converging wall defining a vertical axis (22) for said vessel, a first upper segment (12) being vertically arranged above a second lower segment (14), each one of said wall segments having an upper edge and a lower edge, the perimeter of the upper edge of said second lower wall segment (14) being larger than the perimeter of the lower edge of said first upper wall segment (12); said lower edge of said first upper wall segment (12) and said upper edge of said second lower wall segment (14) being positioned proximate to each other and cooperating to provide an enlargement (42) of the cross-sectional area of the volume occupied by said particulate solid material; and the lower edge of said first upper segment (12) defining a plane forming an angle (B) in the range from 30° to 70 ° with respect to said vertical axis (22) of said vessel.

24. Vessel according to claim 23, wherein the plane defined by the lower edge of said first upper segment (12) forms an angle (B) in the range from 45° to 55° with respect to said axis (22) of said vessel.

25. Vessel according to claim 23, wherein said downwardly converging walls of said segments (12, 14) form a converging angle (A) in the range from 8° to 45° with respect to the vertical axis (22) of said vessel.

26. Vessel according to claim 25, wherein said downwardly converging walls of said segments form a converging angle (A) in the range from 10° to 20° with respect to the vertical axis (22) of said vessel.

27. Vessel according to claim 23, further comprising a wall element (34) joining the lower portion of said first upper wall segment (12) and the upper portion of said second lower wall segment (14) and enclosing a recess space (42) formed by the said enlargement of the cross-sectional area in said vessel.

28. Vessel according to claim 23, comprising a plurality of downwardly converging wall segments (12, 14, 16, 18, 20) substantially vertically centered with respect to the vertical axis (22) of said vessel and forming a plurality of recess spaces (42, 44, 46, 48) formed by a plurality of enlargements of the cross-sectional area of the volume occupied by said particulate solid material and wherein the lowermost wall segment (20) converges to an outlet discharge (32, 60) for said material.

29. Vessel according to claim 28, wherein said recess spaces are continuous and conformed in a plane which forms an angle (B) in the range of 30° to 70° with respect to the axis of said vessel.

30. Vessel according to claim 29, wherein said angle (B) of the recess spaces has different values for each one of the plurality of wall segments.

31. Vessel according to claim 28, wherein the angle (A) of each wall segment decreases progressively from said first segment to the lowest wall segment of said vessel.

32. Vessel according to claim 28, wherein the orientation of at least one of the elliptical recess spaces is different as compared to the other space recesses.

33. A vessel according to claim 28, wherein the highest point of an elliptical recess space is located at a level at the same height or above the level of the lowest point of the recess space above it, thus providing a continuous and successive asymmetries in a portion of the walls of said vessel.

34. A vessel according to claim 23, comprising a plurality of discharge outlets.

35. A vessel according to claim 23, wherein said cross-sectional area has a circular shape.

36. A vessel according to claim 23, wherein said cross-sectional area has a rectangular shape.

37. A vessel according to claim 23, wherein its downwardly converging wall has a conical shape and the lower edge of said first wall segment is elliptical.

38. A vessel according to claim 23, wherein said vessel is a direct reduction reactor (52) for processing particles containing iron oxides to produce particles containing metallic iron known as DRI.

39. A vessel according to claim 38, wherein angle (A) is in the range from 10° to 16° and angle (B) is in the range of 45° to 55°.

40. A vessel according to claim 38, wherein said reduction reactor (52) has said space recesses and enlargements of cross-sectional area proximate to its discharge outlet (60).

41. A vessel according to claim 39, wherein said reduction reactor has four space recesses (42, 44, 46, 48) and enlargements of cross-sectional area.

42. A vessel according to claim 23, wherein said vessel is a holding bin (72) for small-sized particulate materials and which comprises means (74, 76, 78) for injecting a fluid into said bin through the recess spaces (42, 46, 48) formed by the wall segments of said vessel.

43. Vessel as claimed in claim 6, wherein the converging wall of the upper wall segment (12) forms a converging angle (A) in the range from 10° to 20° with respect to the longitudinal axis (14') thereof.

44. Vessel as claimed in claim 43, wherein the converging wall of the upper wall segment (12) forms a converging angle (A) in the range from 11° to 18° with respect to the longitudinal axis (14') thereof.

45. Vessel as claimed in claim 8, wherein the angle of inclination of the plane of truncation forms an angle (B) in the range from 35° to 55° with respect to the longitudinal axis of the upper wall segment.

46. Vessel as claimed in claim 45, wherein the angle of inclination of the plane of truncation forms a 40° angle (B) with respect to the longitudinal axis of the upper wall segment.

47. Vessel as claimed in claim 9, wherein the converging wall of the lower wall segment (14) forms a converging angle (A) in the range from 10° to 20° with respect to the longitudinal axis (14') thereof.

48. Vessel as claimed in claim 47, wherein the converging wall of the lower wall segment (14) forms a converging angle (A) in the range from 11° to 18° with respect to the longitudinal axis (14') thereof.

49. Vessel as claimed in claim 11, wherein the angle of inclination of the plane of truncation forms an angle (B) in the range from 35° to 55° with respect to the longitudinal axis (14') of the lower wall segment (14).

50. Vessel as claimed in claim 49, wherein the angle of inclination of the plane of truncation forms a 40° angle (B) with respect to the longitudinal axis (14') of the lower wall segment (14).

* * * * *